US006058894A

United States Patent [19]

Kobayashi et al.

[11] Patent Number: 6,058,894

[45] Date of Patent: May 9, 2000

[54] GENERAL-PURPOSE AIR-COOLED FOUR-CYCLE ENGINE

[75] Inventors: Kazuyuki Kobayashi; Hiroyoshi Kouchi; Shogo Nakamura; Yuji Nagase, all of Nagoya, Japan

[73] Assignee: Mitsubishi Heavy Industries, Ltd., Tokyo, Japan

[21] Appl. No.: 09/104,394

[22] Filed: Jun. 25, 1998

[30] Foreign Application Priority Data

Jun. 25, 1997 [JP] Japan ..... 9-184396

[51] Int. Cl.[7] ..... F01P 1/00; F02B 75/32; F02D 31/00

[52] U.S. Cl. ..... 123/41.56; 123/197.4; 123/363; 123/376; 74/336.5

[58] Field of Search ..... 123/41.56, 197.1, 123/197.4, 195 H, 365, 363, 376; 74/336.5

[56] References Cited

U.S. PATENT DOCUMENTS

| | | | |
|---|---|---|---|
| 4,100,909 | 7/1978 | Nakano et al. | 123/196 AB |
| 4,156,409 | 5/1979 | Nakano | 123/41.65 |
| 4,515,120 | 5/1985 | Amemori et al. | 123/368 |
| 5,031,591 | 7/1991 | Shinoda et al. | 123/196 W |
| 5,447,127 | 9/1995 | Luck et al. | 123/90.31 |

FOREIGN PATENT DOCUMENTS

| | | |
|---|---|---|
| 294 786 A2 | 6/1988 | European Pat. Off. . |
| 475 772 A2 | 9/1991 | European Pat. Off. . |
| 567 037 A1 | 4/1993 | European Pat. Off. . |
| 609 094 A1 | 1/1994 | European Pat. Off. . |
| 56-165140 | 12/1981 | Japan . |
| 2-41329 | 11/1990 | Japan . |
| 5-44522 | 2/1993 | Japan . |

*Primary Examiner*—Tony M. Argenbright
*Assistant Examiner*—Brian Hairston
*Attorney, Agent, or Firm*—Evenson, McKeown, Edwards & Lenahan, P.L.L.C.

[57] ABSTRACT

A general purpose air-cooled, four-cycle engine in which a first ball bearing supporting the output shaft of the crankshaft is larger than the second ball supporting the other end of the crankshaft, and the first bearing has an external diameter which is approximately equal to or greater than the distance from the crankshaft to the camshaft. The camshaft driven by the crankshaft is supported by sliding bearings. The governor which controls the rotation of the engine and which is driven by the rotation of the crankshaft is enclosed in the crankcase on the same end as the cooling fan, which is the end opposite the output end of the crankshaft. This invention fulfills the demand for a smaller crankcase; does not make use of special bearings; and achieves a greater bearing capacity through the use of large-diameter standard-precision ball bearings. In addition, it simplifies the required processing and allows the assembly process to be automated.

2 Claims, 3 Drawing Sheets

GENERAL-PURPOSE AIR-COOLED FOUR-CYCLE ENGINE

FIELD OF THE INVENTION

This invention concerns a general-purpose air-cooled four-cycle engine of the sort in which the crankshaft is supported by two ball bearings placed on either end of the crankcase, which includes a cover, and in which one end of the crankshaft is the output shaft. More specifically, it concerns the configuration of the bearings in the crankcase of such a general-purpose air-cooled four-cycle engine.

BACKGROUND OF THE INVENTION

General-purpose air-cooled four-cycle engines have various requirements depending on what sort of working machine the engine is to serve. A compressor, an axial-flow pump, or an outboard engine directly connected to the propeller shaft requires high-speed revolution, so for these applications the crankshaft is used as the output shaft. Much farm equipment, on the other hand, requires low-speed output. Since the camshaft has a rotary speed half that of the crankshaft, it is used as the output shaft for this sort of application.

The crankshaft in an engine such as those described above, in which the crankshaft serves as the output shaft, is supported by ball bearings on both ends. These ball bearings must have a load rating which allows them to handle the radial load which the pistons receive from the pressure of combustion gases in the cylinder head as well as the additional radial and thrust loads imposed on the output shaft from the exterior. Generally, standard ball bearings with an intermediate load rating are used in these engines; and for the sake of interchangeability of parts and processes, the same size of bearing is generally used on both ends of the crankshaft.

A governor is essential in a multipurpose engine to adjust the r.p.m. Normally, a mechanical governor is enclosed in the crankcase and driven directly by the crankshaft. An example of such a governor is provided in Japanese Patent Publication (Kokai) Heisei 5-44522. We shall now discuss its configuration with reference to FIG. 3 below.

FIG. 3 shows the configuration of the components inside the crankcase. In the drawing, crankshaft 5 comprises crankshaft portions $\mathbf{5}a_1$ and $\mathbf{5}a_2$, crank arms 5*b* and crank pin 5*c*. The shaft portions $\mathbf{5}a_1$ and $\mathbf{5}a_2$ are supported at two points by ball bearings 40*a* and 40*b*, of identical external diameter, which are mounted on crankcase 17 and cover 18, respectively. Timing gear 3 is shaft-coupled to shaft portion $\mathbf{5}a_1$ on the output end of the crankshaft 5. The rotary force of crankshaft 5 is transmitted to camshaft 7 by means of cam gear 8. Camshaft 7 is supported at two points by sliding bearings 70*a* and 70*b*, of identical external diameter, which are mounted on crankcase 17 and cover 18, respectively.

With the prior technology, gear 2, which drives the governor, is installed at the side of crankshaft portion $\mathbf{5}a_1$ (output shaft), and the outer side (right side) of timing gear 3 as shown in FIG. 3. Small governor 10 is enclosed in space 70, which extends downward between the bottom of output shaft portion $\mathbf{5}a_1$ in crankcase 17 and the bottom of crankcase 17 and cover 18. This design led to a demand that the size of the crankcase be reduced slightly so that the engine could be made smaller.

Some loads placed on the output shaft of this sort of crankshaft, for example an axial-flow pump or a propeller shaft directly coupled to an outboard engine, entail a large thrust load in the direction in which the output shaft pulls. For these loads, the bearing configuration used in the prior art, such that the crankshaft is supported at two points by ball bearings with the same exterior diameter, has insufficient bearing capacity, so that the bearings will not be durable over a long period of time.

If bearings of a larger diameter are used, the distance between the crankshaft and the camshaft increases, so the crankcase must be made larger. This goes counter to the goal of downsizing the crankcase.

It would be possible in this situation to use the same size of bearings but choose different materials, so that the bearings had a very precise fit and the bearing capacity was increased. However, such a special bearing would then be necessary to increase the precision of the fit with the crankshaft. This would entail selective fitting, which would pose a problem in terms of robotic assembly. Also, since standard specifications of bearings and this kind of special bearing have the same appearance in size, there would always be the chance of an assembly error by selecting wrong one.

Another problem with the existing design is that in addition to the cam gear and cam bearings, the governor and governor drive gear are also placed on the output end (right side in FIG. 3) of the crankshaft. No matter how much effort is put into reducing the size of the crankcase, space 70, which extends downward between the bottom of the crankshaft and the base of crankcase 17 and cover 18, is still needed. This makes the crankcase larger than is desirable.

SUMMARY OF THE INVENTION

The object of this invention is to fulfill the demand to reduce the size of the crankcase and to provide an air-cooled general-purpose four-cycle engine with the following features: it would not use any special bearings; it would use large, standard-precision ball bearings with a larger bearing capacity; and this would simplify the production process and enable robotic assembly. As a result of these improvements, the cost of producing and assembling the engine would go down and there would be no danger of assembly error.

The invention designed to solve these problems is a general-purpose air-cooled four-cycle engine of the sort in which the crankshaft is supported by two ball bearings placed on either end of the crankcase, which includes a cover, and in which one end of the crankshaft is the output shaft.

This four-cycle engine is distinguished by the following features. The external diameter of the ball bearing placed on the output shaft of the crankshaft is greater than that of the ball bearing placed on the other end of the crankshaft. Preferably, the external diameter of the bearing on the output shaft should be approximately equal to or greater than the distance between the crankshaft and the camshaft. The camshaft is driven by the crankshaft and is supported by sliding bearings (plain bearings).

With this invention, high load-capacity ball bearings of large external diameter are used on the output shaft of the crankshaft. When the engine is installed in a working machine with a large thrust load, such as an axial-flow pump, these bearings provide sufficient bearing capacity and durability.

The use of large-diameter bearings increases the distance between the crankshaft and the camshaft, which necessarily results in a larger crankcase. However, with this invention the camshaft is supported by sliding bearings, which allows smaller diameter bearings to be used. This design provides a simple way for the crankcase to be made smaller.

In a further preferred embodiment of the invention, the governor driven by the rotation of the crankshaft is enclosed within the crankcase near the cooling fan on the end of the crankshaft opposite the output shaft.

With this invention, the cam gear and its associated cam bearing are on the same end of the case as the output shaft of the crankshaft. The governor which controls the engine speed and the gear which drives the governor are on the opposite end of the case, where the cooling fan is located. This design, in which the crank pin in the central portion of the crankcase separates the left and right sides, obviates the need for a specially extended space in the crankcase and allows the crankcase to be made smaller.

A BRIEF EXPLANATION OF THE DRAWINGS

DETAILED DESCRIPTION OF THE INVENTION

Figure 1:
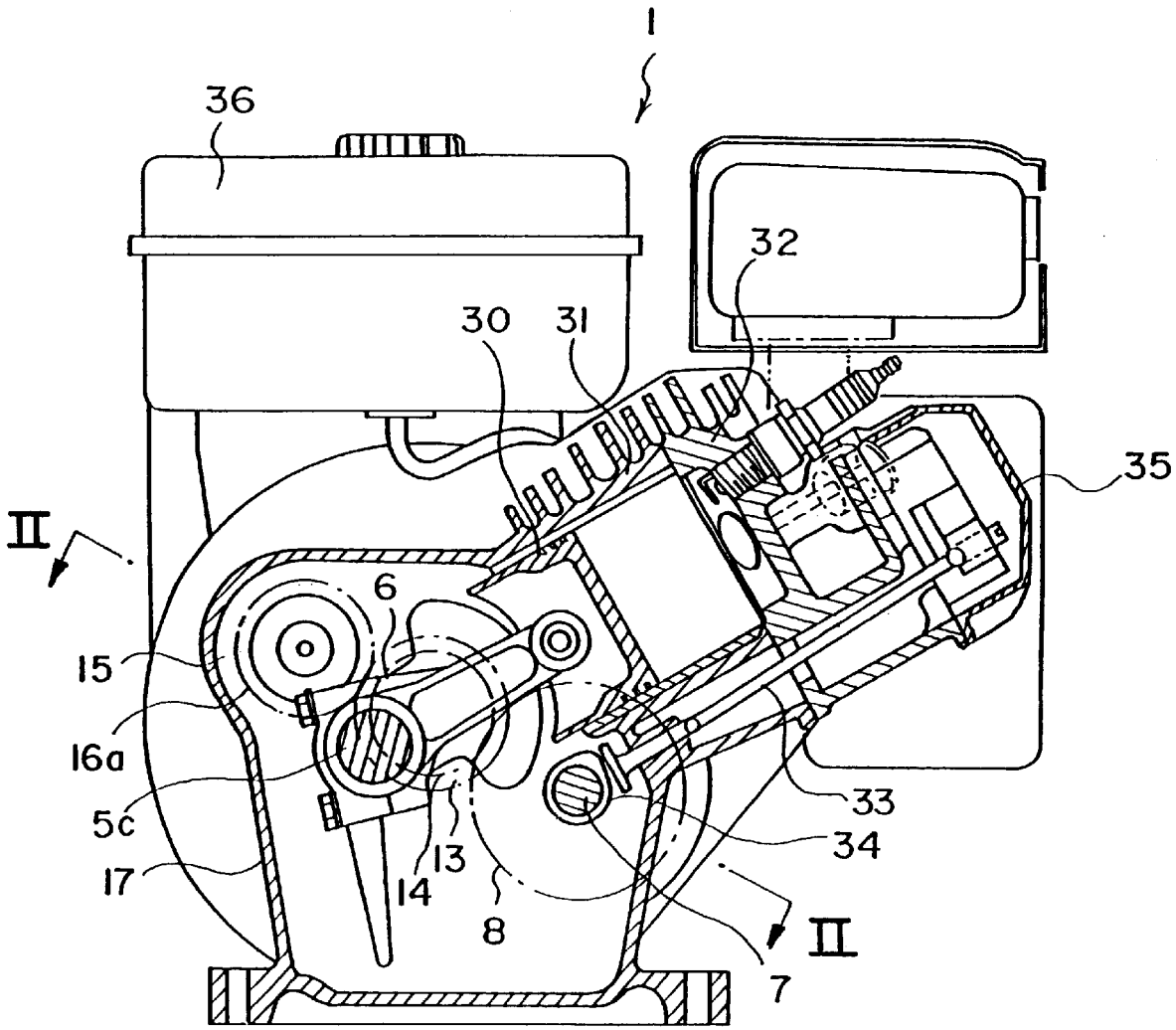
FIG. 1 is a lateral cross section of a four-cycle single-cylinder engine which is a preferred embodiment of this invention.
Figure 2:
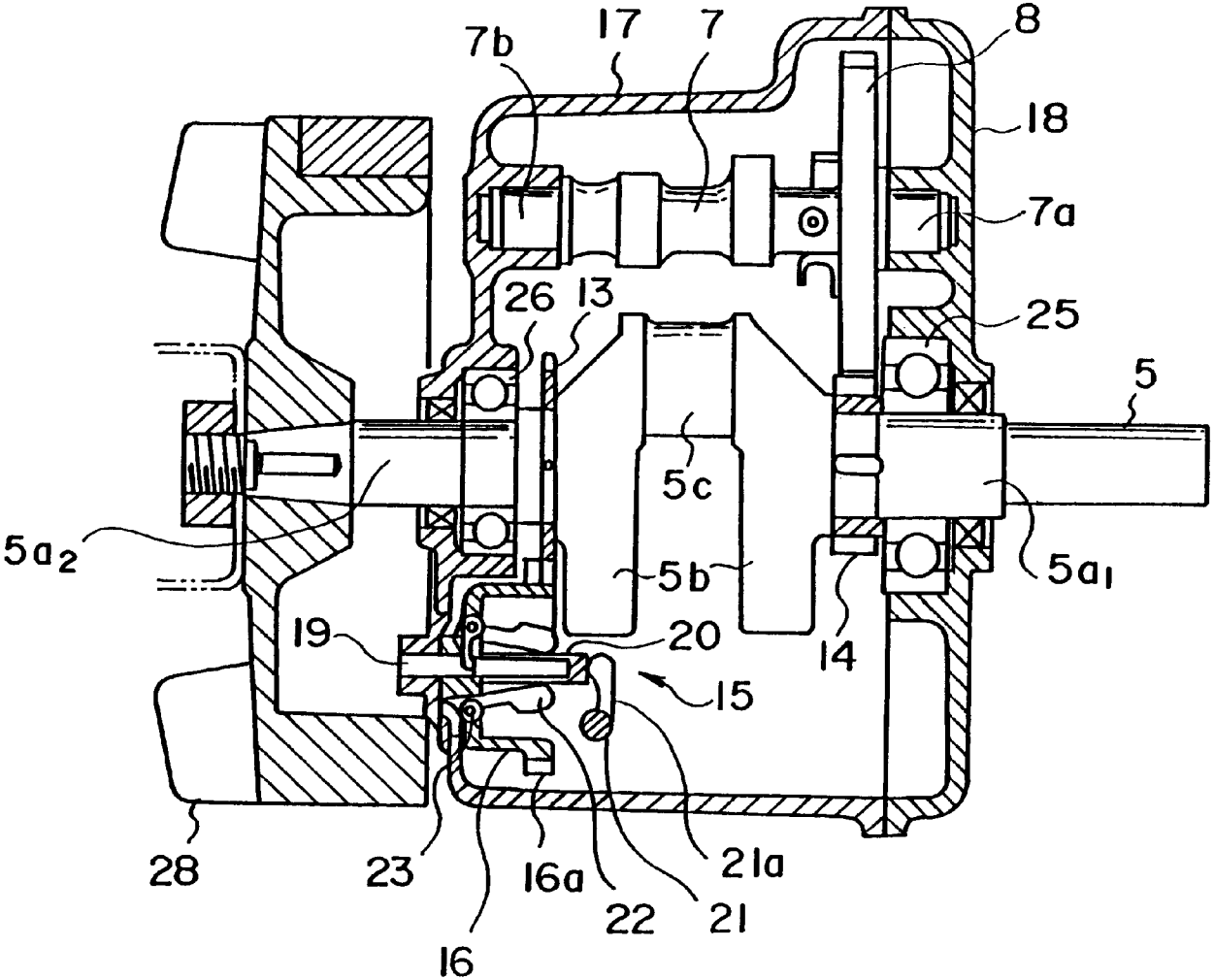
FIG. 2 is a cross section taken along line II—II in FIG. 1.
Figure 3:
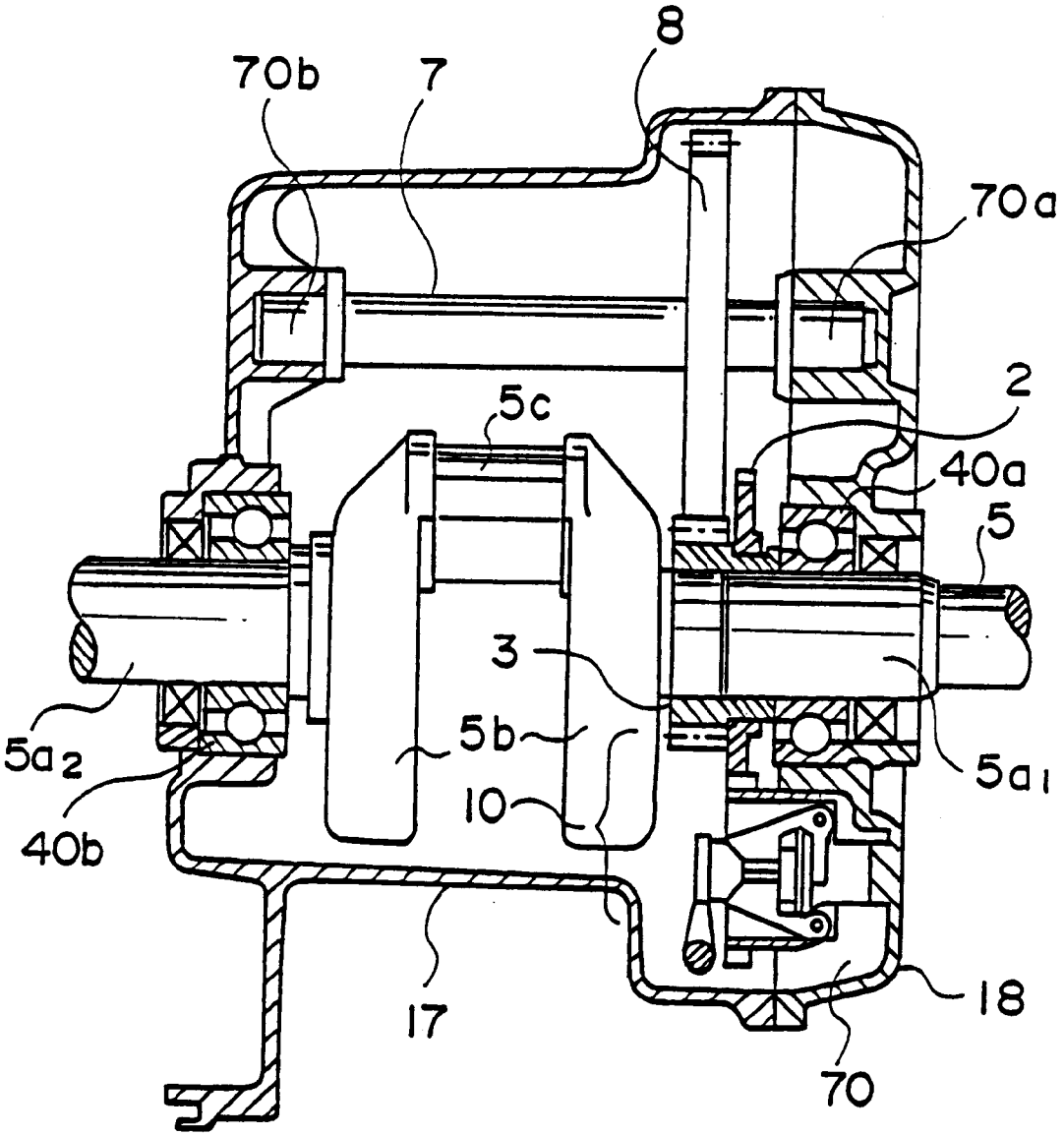
Figure 3 PRIOR ART
FIG. 3 is a cross section showing the location of the governor in a four-cycle single-cylinder engine belonging to the prior art.

The next section gives a detailed explanation of a preferred embodiment of this invention with reference to FIGS. 1 and 2. This embodiment is an inclined cylinder-type four-cycle single-cylinder engine for general use in which the present invention is employed. Insofar as the dimensions, material, shape and relative position of the structural components of this embodiment which are described are not meant to be specific disclosures, the scope of the invention is not limited to those shown. The embodiment is meant to serve merely as an illustrative example.

FIG. 1 is a lateral cross section of a single-cylinder four-cycle engine which is a preferred embodiment of this invention. FIG. 2 is a cross section taken along line A-A in FIG. 1.

In these drawings, 1 is the entire inclined-cylinder type single-cylinder four-cycle engine. 5 is the crankshaft, which comprises crankshaft portions $5a_1$ and $5a_2$crank arms 5*b* and crank pin 5*c*. The shaft portions $5a_1$ and $5a_2$ are supported at two points by ball bearings 25 and 26, which are mounted on crankcase 17 and cover 18 respectively. A cooling fan 28, which shares a flywheel magnet, is mounted on the end of the case opposite the output shaft of the crankshaft 5.

These aspects of the design are just as in the prior art. This embodiment differs from prior art devices in that the external diameter of ball bearing 25, which is mounted on cover 18 on the output end of the crankshaft 5, is greater than that of ball bearing 26, which is placed on the same end as cooling fan 28. Preferably, ball bearing 25 on cover 18 on the same end as the output shaft of crankshaft 5 should have a high load capacity and an external diameter which is equal to or greater than the distance between crankshaft 5 and camshaft 7.

Ball bearing 26, which is placed on the same end as cooling fan 28, should be an ordinary bearing of the same size as is used in the prior art.

Thus, in addition to the radial thrust which piston 30 receives from the pressure of the combustion gases in the cylinder, ball bearings 25 must be able to withstand the large radial load which crankshaft 5 receives directly as the output shaft as well as the large thrust load in the direction in which the output shaft is pulled.

Gear 14, which drives the cam, is attached to shaft portion $5a_1$ of crankshaft 5; gear 13, which drives the governor, is attached to shaft portion $5a_2$ at the opposite end of the case where cooling fan 28 is located. Gear 14 engages with cam gear 8 so that the rotary force of crankshaft 5 can be transmitted to camshaft 7.

Camshaft 7 is supported at two points by sliding bearings 7*a* and 7*b* of identical external diameter. These bearings are mounted, respectively, on crankcase 17 and cover 18.

Sliding bearings 7*a* and 7*b* are plain bearings having a diameter slightly greater than camshaft 7 which are inserted through holes in crankcase 17 and cover 18 either directly or with intermediate metal casings or bushings.

Governor 15 is installed in crankcase 17 below shaft portion $5a_2$ on the same end as cooling fan 28. The governor 15 comprises rotating cylinder 16, to which is affixed gear 16*a*, which in turn is driven by gear 13, which itself is shaft-coupled to crankshaft 5. Governor 15 further comprises shafts 23, which are mounted to the rotating cylinder 16 in a symmetrical pattern; weights 22, which are supported on the shafts 23 in such a way that they are free to rotate; governor 19, which is mounted to crankcase 17; movable cylinder 20, which has a flange; and governor output shaft 21, which outputs the displacement of the governor. When the rotation of the governor is transmitted to rotating cylinder 16 via gears 13 and 16*a*, centrifugal force causes weights 22, which rotate with cylinder 16, to push against movable cylinder 20. The displacement of movable cylinder 20 is transmitted to the exterior of crankcase 17 via arm 21*a* as the angular displacement of shaft 21.

A lever (not shown) is mounted to the outer portion of shaft 21 which protrudes from crankcase 17. This lever, which is biased by a spring (not shown) in the direction which pushes arm 21*a* back to its original position, is connected to the throttle valve of a carburetor (not shown). By increasing and decreasing the force of the spring attached to the lever, the r.p.m. of the engine can be controlled.

In FIG. 1, 6 is a connecting rod which joins piston 30 to crank pin 5*c*. 31 is the cylinder; 32 is the cylinder head; 35 is the head cover; 36 is the fuel tank; 34 is the cam attached to camshaft 7; 33 is the push rod which is driven back and forth by the cam, and which is one component of the mechanism which controls the opening and closing of the intake/exhaust valve. Since this mechanism is known in the art, it will not be described in detail.

The operation of this embodiment will next be discussed. Shaft portion $5a_1$ on the output end of crankshaft 5 is supported by large heavy-duty ball bearings 25, so when crankshaft 5 is used as an output shaft, it can easily tolerate large radial loads. In addition, crankshaft 5 may be directly shaft-coupled to an external load which entails a significant thrust load in the direction in which the output shaft is drawn, such as an axial-flow pump or an outboard engine to which a propeller shaft is directly connected. The bearings are rugged enough to tolerate such a load.

Although the central portion of cover 18 around where shaft portion $5a_1$ is mounted is occupied by large-diameter ball bearings 25, camshaft 7 can be directly supported by sliding bearings 7*a* and 7*b*, which are inserted through holes in cover 18. (Metal casings or bushings may be used as needed.) Bearings 7*a* and 7*b* have a diameter which is equal to or slightly greater (when bushings are used) than that of camshaft 7. There is thus no need to provide a long space or distance between crankshaft 5 and camshaft 7. In addition to this feature, as can be seen in FIG. 2, governor 15 is enclosed in crankcase 17 on the same end as cooling fan 28, the end opposite the output shaft. This arrangement allows the volume of the crankcase to be kept from becoming too large.

As has been described above, with this invention large-diameter, large load-capacity ball bearings are used to support the output end of the crankshaft. The bearings have a capacity sufficient to withstand the engine being directly connected to a load with a great deal of vibration or one with a large thrust load in the direction in which the output shaft is being drawn. Even under such conditions, they will remain durable. There is no need to use special bearings with a greater bearing capacity. Rather, large-sized standard precision bearings may be used. Since the bearings can be machined to a standard tolerance, the assembly process can be automated. This lowers the cost of parts, processing and assembly and eliminates the possibility of assembly error.

Even though large-diameter ball bearings are used on the output end of the crankshaft, the camshaft is supported by sliding bearings which are inserted directly through holes in the crankcase or in cover 18 (or are inserted into bushings). This scheme eliminates the need for a large space between the two shafts. The governor which controls the speed at which the engine rotates and which is driven by the crankshaft is enclosed in the crankcase on the same end as cooling fan 28, opposite the end of the case where the output shaft is. This allows the crankcase to be kept small.

As a result of this invention, an air-cooled four-cycle engine for general use is provided which fulfills the demand for a smaller crankcase; does not make use of special bearings; achieves a greater bearing capacity through the use of large-diameter standard-precision ball bearings; simplifies the required processing; and allows the assembly process to be automated. This results in lower processing and assembly costs and eliminates the possibility of assembly error.

We claim:

1. A general-purpose air-cooled four-cycle engine comprising:

a crankshaft having one end which is used as an output shaft;

first and second ball bearings placed respectively on either end of a crankcase for supporting the crankshaft;

a camshaft for opening and closing intake and exhaust valves in the engine; and a pair of sliding bearings supporting the camshaft in the crankcase;

one of said first and second ball bearings which supports the one end of the crankshaft having a greater external diameter than the other of said first and second ball bearings which supports an opposite end of the crankshaft;

the external diameter of the one of said ball bearings being at least equal to a distance between the crankshaft and the camshaft; and a governor driven by rotation of the crankshaft enclosed within the crankcase adjacent said opposite end of the crankshaft.

2. A general-purpose air-cooled four-cycle engine according to claim 1, and further comprising a first gear for driving the camshaft by way of said crankshaft disposed adjacent to one end of the crankshaft near the first ball bearing and a second gear for driving said governor so as to transfer rotating power from the crankshaft to said governor to adjust a rotation rate disposed adjacent to the opposite end of the crankshaft near the second ball bearing, each of said first and second gears being disposed outside of right and left sides of a crank-pin of the crankshaft.

* * * * *